US006491754B1

(12) United States Patent
Graf et al.

(10) Patent No.: US 6,491,754 B1
(45) Date of Patent: Dec. 10, 2002

(54) CARBON FIBER DOCTOR BLADE

(75) Inventors: Edwin X. Graf, Menasha, WI (US); James A. Eng, Appleton, WI (US)

(73) Assignee: Voith Sulzer Paper Technology North America, Inc., Appleton, WI (US)

( * ) Notice: Subject to any disclaimer, the term of this patent is extended or adjusted under 35 U.S.C. 154(b) by 71 days.

(21) Appl. No.: 09/593,984

(22) Filed: Jun. 13, 2000

(51) Int. Cl.[7] ..... B05C 11/04

(52) U.S. Cl. ..... 118/123; 118/126; 118/203; 118/261; 162/281

(58) Field of Search ..... 118/123, 126, 118/203, 261, 413; 101/157, 169, 365; 162/281; 15/256.5, 256.51; 427/356

(56) References Cited

U.S. PATENT DOCUMENTS 4,789,432 A * 12/1988 Goodnow et al. ..... 118/261
5,356,519 A * 10/1994 Grabscheid et al. ..... 162/281
5,824,154 A * 10/1998 Freti ..... 118/126
5,870,657 A * 2/1999 Nagame et al. ..... 399/174
5,980,692 A * 11/1999 Goodnow et al. ..... 162/281
6,134,405 A * 10/2000 Zona ..... 399/148
6,299,732 B1 * 10/2001 Rekila ..... 162/272

OTHER PUBLICATIONS

J. A. Kent, *Riegel's Handbook of Indrustrial Chemistry*, Ninth Edition, pp. 789–791, 1992.*

Kirk–Othmer, *Encyclopedia of Chemical Technology*, Fourth Edition, pp. 1–5, 16, and 17, 1993.*

* cited by examiner

*Primary Examiner*—Laura Edwards
(74) *Attorney, Agent, or Firm*—Taylor & Aust, P.C.

(57) ABSTRACT

An apparatus for one of direct and indirect application of a coating medium onto a traveling fiber material web includes at least one doctor element for application and/or metering of the coating medium. At least one doctor element is formed of a carbon fiber material.

8 Claims, 3 Drawing Sheets

CARBON FIBER DOCTOR BLADE

BACKGROUND OF THE INVENTION

1. Field of the Invention.

The present invention relates to doctor blades, and, more particularly, to a doctor blade for leveling and/or metering a layer of liquid or viscous coating medium.

2. Description of the Related Art.

A doctor blade is used to level and/or meter coating medium onto a moving background. With direct application of the coating medium, a moving background is a material web, such as a paper or cardboard web. With indirect application, a moving background is the surface of a transfer element which transfers the coating medium onto the material web.

It is known for a doctor blade to be formed of materials such as high carbon spring steel, beryllium copper, stainless steel or fiberglass. A problem is that these materials have generally poor wear characteristics.

What is needed in the art is a doctor blade that has higher strength and better wear characteristics.

SUMMARY OF THE INVENTION

The present invention provides a doctor blade formed of a high strength composite material, such as carbon fiber. Also provided are various arrangements for positioning such a doctor blade relative to the moving background.

The invention comprises, in one form thereof, an apparatus for one of direct and indirect application of a coating medium onto a traveling fiber material web. At least one doctor element applies and/or meters the coating medium, and is formed of a carbon fiber material.

An advantage of the present invention is that, because of the higher strength and wear characteristics of the carbon fiber material, the doctor blade has a longer useful life.

Another advantage is that the doctor blade has better lubricity because of the carbon material.

Yet another advantage is that the position of the doctor blade relative to the moving background can be closely controlled.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
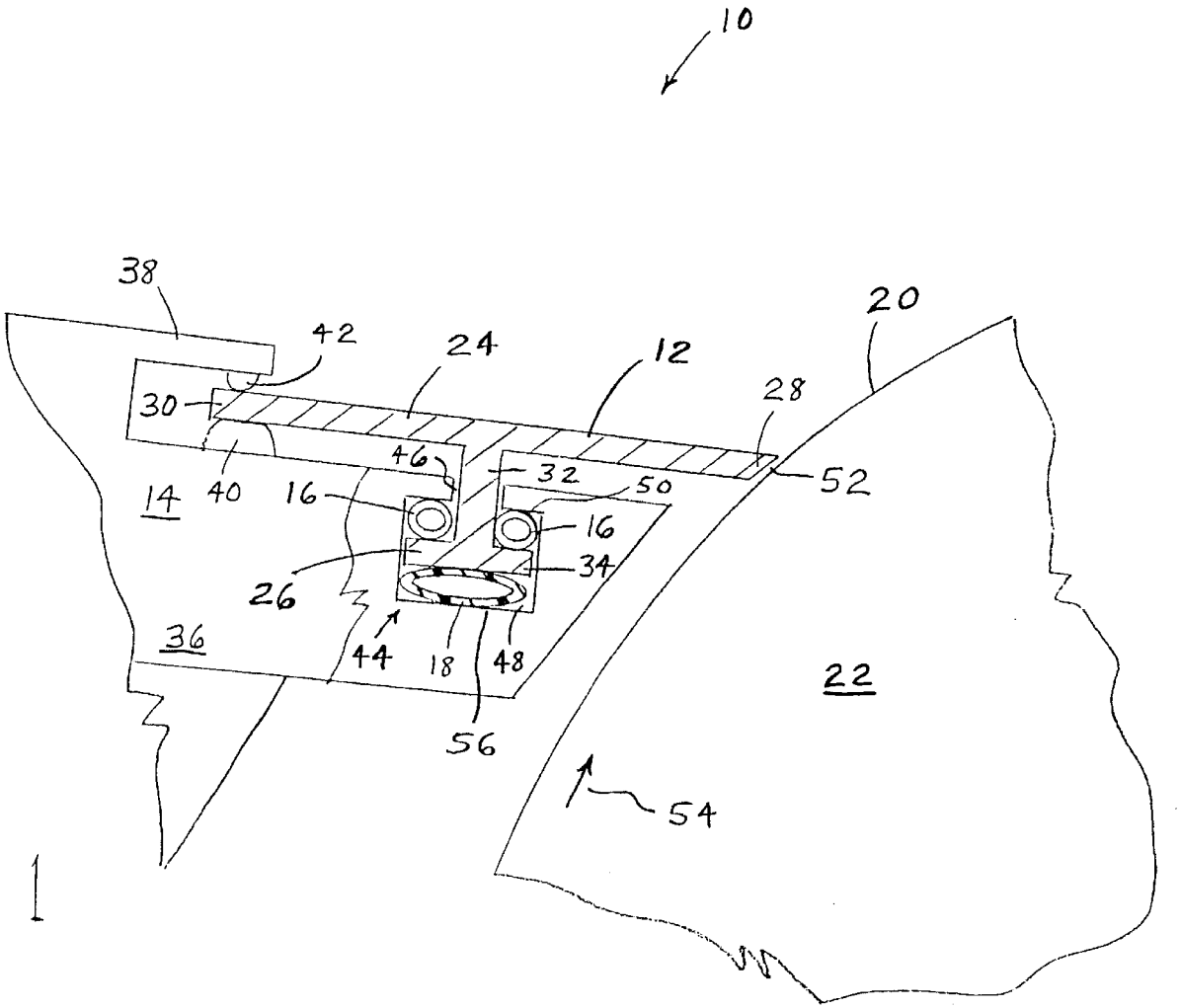
FIG. 1 is a fragmentary, side view of one embodiment of the apparatus of the present invention.

Referring now to the drawings, and more particularly to FIG. 1, there is shown one embodiment of a doctor blade apparatus 10 of the present invention, which generally includes a doctor blade 12, a doctor holder 14, a first air hose 16 and a second air hose 18. Doctor blade apparatus 10 operates to level and/or meter coating medium on a surface 20 of roll 22.

Doctor blade 12 is formed of a carbon fiber material, providing doctor blade 12 with high levels of strength and durability. Doctor blade 12 includes a body portion 24 and a T-shaped projection 26 extending therefrom. Body portion 24 includes a chamfered first end 28 for engaging the coating medium on surface 20. An opposite end 30 of body portion 24 is clamped in a fixed position in doctor holder 14. Projection 26 includes a base 32 and head portion 34 oriented perpendicular to base 32.

Doctor holder 14 includes a base 36 and an extending arm 38 having respective clamping devices 40 and 42 for securely holding end 30 of doctor blade 12. Base 36 includes a cavity 44 having a through slot 46 opening into a wider chamber 48. Chamber 48 retains each of air hoses 16, 18 and head 34 of projection 26 therein.

During operation, end 28 of doctor blade 12 can be moved away from or toward surface 20 by adjusting the relative air pressures in hoses 16 and 18. For example, if the pressure within hose 16 is increased relative to the air pressure in hose 18, hose 16 exerts a force on head 34, thereby moving projection 26 away from wall 50 of chamber 48. Movement of projection 26 away from wall 50 tends to cause a rotation of doctor blade 12 about its end 30, clockwise in FIG. 1, such that end 28 is moved toward surface 20 of roll 22. A gap 52 is shown between end 28 and surface 20. Increasing the air pressure in air hose 16 reduces gap 52 and may cause end 28 to come into contact with surface 20 and/or the coating medium that is carried in direction 54 on surface 20.

Conversely, increasing the air pressure in hose 18 relative to the air pressure in hose 16 exerts a force on projection 26 that moves projection 26 away from wall 56 of chamber 48. Such movement of projection 26 causes end 28 to move away from surface 20 to thereby increase or create gap 52. Thus, by adjusting the air pressure in hoses 16 and 18, the size of gap 52, or the force exerted by end 28 on surface 20, can be tightly controlled.

In an alternative embodiment (not shown), air hose 16 or air hose 18 is replaced by a spring, such as a coil spring. Thus, the spring and the air hose exert opposite forces on projection 26 to establish an equilibrium position of end 28. By adjusting the air pressure within the air hose, the position of end 28 can be closely controlled.

In another embodiment (FIG. 2), a doctor holder 58 includes a slot 60 for retaining an air hose 62 which actuates an end 64 of carbon fiber doctor blade 66. Doctor blade 66 includes a pivot point in the form of a recess 68 for receiving a projection 70 of doctor holder 58. Projection 70 extends parallel to doctor blade 66 and includes, at its distal end, a ball 72 with a circular cross section. Ball 72 and recess 68 form a ball-and-socket type of joint which allows doctor blade 66 to rotate in the plane of the page, as indicated by double arrow 74.

In operation, increasing the air pressure within air hose 62 causes hose 62 to inflate and thereby push end 64 away from doctor holder 58. As doctor blade 66 rotates about recess 68, end 76 of doctor blade 66 is moved toward surface 20 of roll 22, as described above with respect to FIG. 1. Conversely, deflation of air hose 62 allows end 76 to move further away from surface 20.

In a third embodiment (FIG. 3), a carbon fiber doctor blade 78 includes a projection 80 having a ball 82 at the distal end thereof. Doctor holder 84 includes a recess 86 for receiving ball 82. Together, ball 82 and recess 86 form a ball-and-socket type joint for allowing pivoting of doctor blade 78 in the directions indicated by double arrow 88.

Doctor blade 78 is symmetrical about a imaginary line 90 that bisects doctor blade 78 through projection 80. End 92 of doctor blade 78 is also chamfered and is identical to end 94. Thus, once end 94 has become worn down from use to the point where it no longer operates effectively, doctor blade 78 can be reversed such that the unworn end 92 is repositioned adjacent to surface 20, and the worn end 94 is repositioned such that it can be actuated by hose 62. More particularly, ball 82 can be removed from recess 86 such that doctor blade 78 is disengaged from doctor holder 84. Doctor blade 78 can then be turned 180 degrees and reattached to doctor holder 84 by inserting projection 80 into recess 86.

Figure 2:
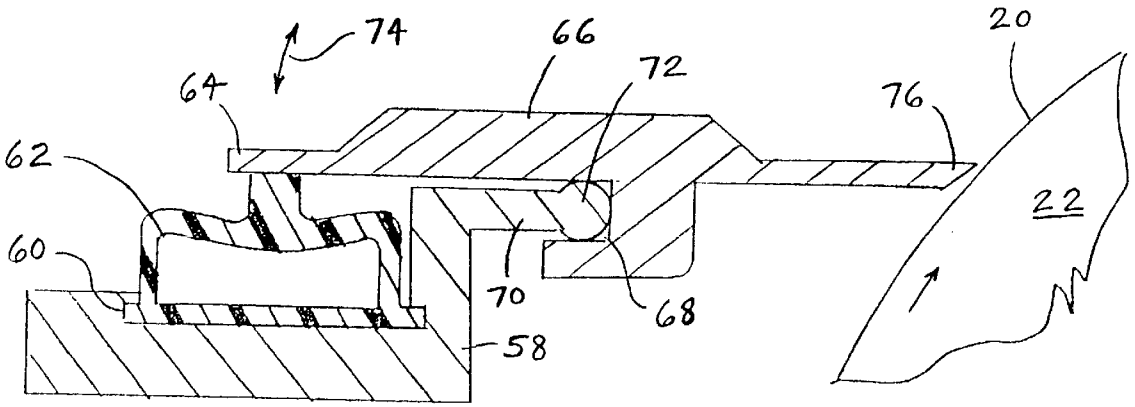
FIG. 2 is a fragmentary, side view of another embodiment of the apparatus of the present invention.

In use, similarly to the embodiment of FIG. 2, inflation of air hose 62 results in end 94 being moved toward or biased against surface 20 of roll 22. Conversely, deflation of hose 62 results in a decrease in pressure on end 92, thereby allowing end 94 to rotate away from surface 20.

In a fourth embodiment (FIG. 4), doctor holder 96 includes a projection in the form of a T-shaped post 98 with a base 100 and a dovetailed head 102. Carbon fiber doctor blade 104 includes a pivot point in the form of a recess 106 having a throughslot 108 leading into a relatively wider chamber 110.

In operation, the dovetailed configuration of head 102 allows doctor blade 104 to pivot about post 98 as air hose 62 actuates end 112 of doctor blade 104. Similarly to the embodiments of FIGS. 2 and 3, inflation of air hose 62 results in end 114 of doctor blade 104 being moved toward or being biased against surface 20 of roll 22. Deflation of air hose 62 allows end 114 to rotate away from surface 20 in the direction of arrow 116.

In the embodiments shown herein, the doctor blades include a projection or a recess on the same side of the doctor blade that is actuated by an air hose. However, it is to be understood that the doctor blade can also have a projection or a recess on a side of the doctor blade that is opposite from the side of the doctor blade that is actuated by an air hose.

Figure 4:
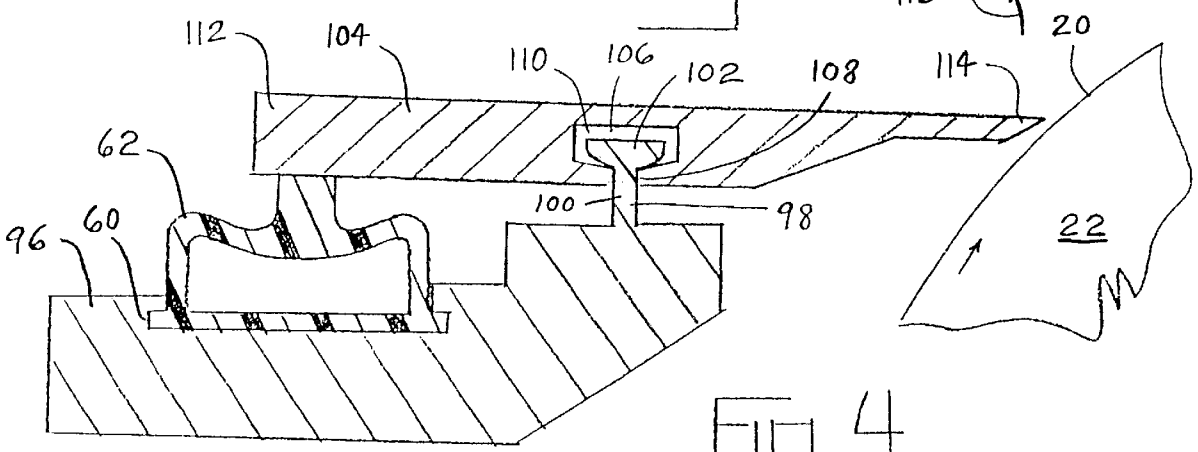
FIG. 4 is a fragmentary, side view of a further embodiment of the apparatus of the present invention.
Figure 3:
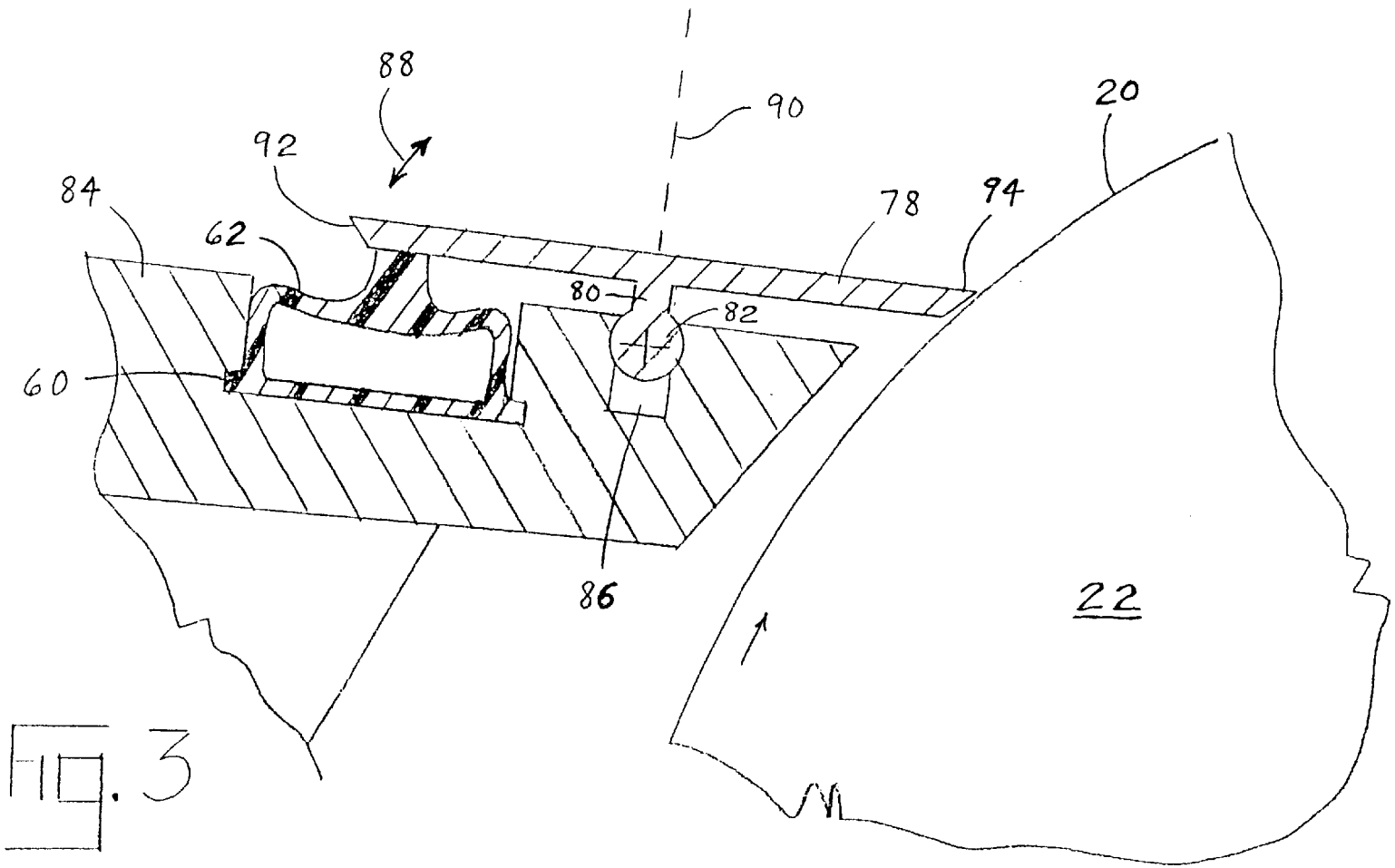
FIG. 3 is a fragmentary, side view of yet another embodiment of the apparatus of the present invention.

It is also possible for the doctor blades of FIGS. 1 and 4 to have identically chamfered opposite ends that allow the doctor blade to be reversed, similarly to the doctor blade of FIG. 3.

The actuators may be in a form other than an air hose. For example, the actuators may be in the form of an electromagnetically actuated ram.

Backing roll 22 has been shown as rotating clockwise in FIGS. 1–4. However, it is also possible for roll 22 to rotate counterclockwise in each of the embodiments. In this case, the doctor blade would function to clean roll 22 or to remove a sheet from surface 20 of roll 22.

The doctor blade has been shown in FIGS. 1–4 as being in a linear, unloaded state. However, it is to be understood that the doctor blade can be deflected if the doctor blade is loaded against roll 22, for instance.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for at least one of leveling and metering a layer of coating medium on a traveling substrate, said apparatus comprising:

a fixed structure having a projection;

a doctor element including:

a first end associated with the traveling substrate;

a second end disposed opposite said first end; and a fixed pivot point disposed between said first end and said second end, said fixed pivot point comprising a recess pivotably receiving said projection, said projection extending substantially parallel to said doctor element; and an actuator configured for rotating said second end of said doctor element about said pivot point to thereby rotate said first end of said doctor element one of toward and away from the traveling substrate.

2. The apparatus of claim 1, wherein said doctor element is formed of a carbon fiber material.

3. The apparatus of claim 1, wherein said actuator comprises an air hose.

4. The apparatus of claim 1, wherein said doctor element is substantially symmetrical about an imaginary line bisecting said doctor element through said fixed pivot point.

5. The apparatus of claim 1, wherein said fixed pivot point further comprises a projection having a substantially circular cross section, said fixed structure further comprising a recess for pivotably receiving said projection of said fixed pivot point.

6. The apparatus of claim 1, wherein said projection has a substantially circular cross section.

7. The apparatus of claim 1, wherein said projection comprises a T-shaped post with a base and a dovetailed head, said base having a first width, said dovetailed head having a second width greater than said first width.

8. The apparatus of claim 1, wherein said recess includes a throughslot in communication with a chamber, said throughslot having a first width, said chamber having a second width larger than said first width.

* * * * *